United States Patent [19]

Bower et al.

[11] 3,951,185

[45] Apr. 20, 1976

[54] HYDROSTATIC TESTER FOR FIRE EXTINGUISHER

[75] Inventors: James C. Bower, Grapevine; Sidney V. Roach, Fort Worth, both of Tex.

[73] Assignee: Pyronauts, Inc., Fort Worth, Tex.

[22] Filed: May 28, 1974

[21] Appl. No.: 473,374

[52] U.S. Cl. ..... 141/1 R; 73/49.2; 134/169 R; 141/89; 141/378; 248/130

[51] Int. Cl.[2] ..... B65B 55/18

[58] Field of Search ..... 73/49.2, 49.8; 134/169 R, 171, 22 R; 137/238; 141/1, 52, 83, 85, 89–92, 94, 231, 285, 290, 369, 372, 378; 248/130, 137, 141, 142, 154

[56] References Cited

UNITED STATES PATENTS

| | | | |
|---|---|---|---|
| 797,318 | 8/1905 | Raw | 248/141 |
| 3,448,745 | 6/1969 | Seeley | 134/169 R |
| R4,796 | 12/1871 | Brooks | 73/49.2 |

*Primary Examiner*—Richard E. Aegerter
*Assistant Examiner*—Frederick R. Schmidt
*Attorney, Agent, or Firm*—James C. Fails

[57] ABSTRACT

The specification discloses a closed system for cleaning, pressure testing, and drying fire extinguisher containers. The system comprises two tanks for holding trichloroethane and flow lines and a valve control system for flowing the liquid from one tank into the container to be cleaned, pressure tested, and dried and then from the container to the other tank. After a number of containers are cleaned and pressure tested and the second tank becomes full, the valve control system can be controlled to reverse the flow of liquid from the second tank to the containers to be cleaned, pressure tested, and dried and then back to the first tank.

In a further embodiment, there is provided a universal head adapted to fit many different sizes of fire extinguisher container openings and in addition an adjustable holding device for holding the container to be tested between a support plate and the head and for inverting the container to allow the container to be emptied after the test is completed.

26 Claims, 4 Drawing Figures

HYDROSTATIC TESTER FOR FIRE EXTINGUISHER

BACKGROUND OF THE INVENTION

This invention relates to a system for cleaning, pressure testing, and drying fire extinguisher containers and more particularly to a closed system, for carrying out such tests, as well as a universal head and holding device employed with the closed system.

According to Federal Regulations and the regulations of other organizations and agencies, fire extinguisher containers employing a dry chemical must be cleaned, pressure tested, and dried at periodic intervals. Conventionally, the fire extinguishers are washed clean of the old dry powder, tested, and then carefully dried for a relatively long period of time to prevent condensation of moisture, and re-filled. This process usually requires two to three hours which necessitates the requirement that the fire extinguisher containers be taken back to the shop to clean and pressure test the containers and to re-fill and re-pressurize the containers for further use.

SUMMARY OF THE INVENTION

It is the object of the present invention to provide a system and method for cleaning, pressure testing, and drying fire extinguisher containers in a minimum period of time which allows the process to be carried out in a van or truck at the industrial site or place of business of the customer thereby saving time, man hours, and gasoline, since the trip back to the shop is eliminated.

The system of the present invention for cleaning, pressure, and drying the fire extinguisher containers comprises a closed system employing a liquid which has good cleaning and drying characteristics, vaporizes rapidly, and is nonflammable. Preferably, the liquid employed is trichloroethane.

It is a further object of the present invention to provide a universal head for coupling two conduits of the closed system to the opening of the container to be tested and in addition, a holding device for holding the container with the head in place over the opening for allowing the test to be conducted and for inverting the container the allow the liquid to be removed after the test.

The closed system comprises two tanks for holding the cleaning, drying, pressure testing liquid, a valve control system and flow lines including first and second conduits coupled to the valve control system and which have first ends adapted to be connected to the opening of the fire extinguisher container to be cleaned, pressure tested, and dried. In carrying out the tests, liquid from one of the tanks is pumped through one of the conduits to the container to fill the container with liquid which then is pressurized for a short period of time. After the pressure test, the container is inverted and liquid flowed from the container to the other of the tanks by way of the other conduit.

In a further aspect, the closed system comprises a first pair of flow lines comprising two lines separately connected to the top ends of the two tanks; first flow control means for separately connecting said first conduit with either of said lines of the first pair; a second pair of flow lines comprising two lines separately connected to the bottom ends of the two tanks; and second flow control means for separately connecting the second conduit with either of the two lines of the second pair of flow lines.

The universal head comprises plate means having a layer of sealing material on one side adapted to engage the rim forming the opening of the fire extinguisher container to be cleaned, tested, and dried. The layer of sealing material is characterized as being resilient, nonporous, capable of withstanding pressures up to 1,000 psi, and unaffected by trichloroethane. In the embodiment disclosed, the layer of sealing material is formed of styrene-butadiene synthetic rubber reinforced with silica. First and second fluid passages extend through the plate means and through the layer of sealing material to be located in fluid communication with the interior of the fire extinguisher container when the plate means and its layer of sealing material are positioned to engage the rim of a fire extinguisher container to be cleaned, tested, and dried. The first and second conduits of the closed system have their first ends connected to said first and second passages respectively of said universal head.

In a further aspect, a sight glass is connected to said first conduit between said first flow control means and said universal head and a high pressure pump is connected to said second conduit between said second flow control means and said universal head.

In carrying out cleaning, pressure testing, and drying operations with the system, liquid may be flowed, for example, from the first tank to the container to be tested by way of the second flow control valve, the high pressure pump, said second conduit and through said second passage of the universal head. Air is flowed out of the container through said first passage of the universal head, through said first conduit and the sight glass and into the other tank by way of the first conduit and the sight glass and into the other tank by way of the first flow control valve. When liquid is viewable through the sight glass with little or no air bubbles, the flow through the first conduit is terminated and the high pressure pump actuated to increase the pressure of the liquid within the container. After a short period of time, the container is inverted and the liquid flowed out of the container to the other tank by way of said first conduit and the first flow control valve. After a number of containers have been cleaned and tested and the second tank becomes full, the first and second flow control valves may be actuated to reverse the flow of liquid from the second tank to the container to be tested and then to the first tank.

The holding device for holding and inverting the container comprises two telescoping members, one of which has a support means connected thereto and the other of which supports a threaded rod to which is connected the universal head whereby the threaded rod and hence the head may be threaded toward or away from the support means. The telescoping members may be adjusted to different positions relative to each other to allow containers of different lengths to be supported and held for test purposes and at the same time restrict the height of the apparatus to allow its installation in a small vehicle. One of the telescoping members is pivotally connected to a stand whereby the container may be held for test purposes and then inverted for emptying the container of the liquid.

DETAILED DESCRIPTION OF THE INVENTION

Figure 1:
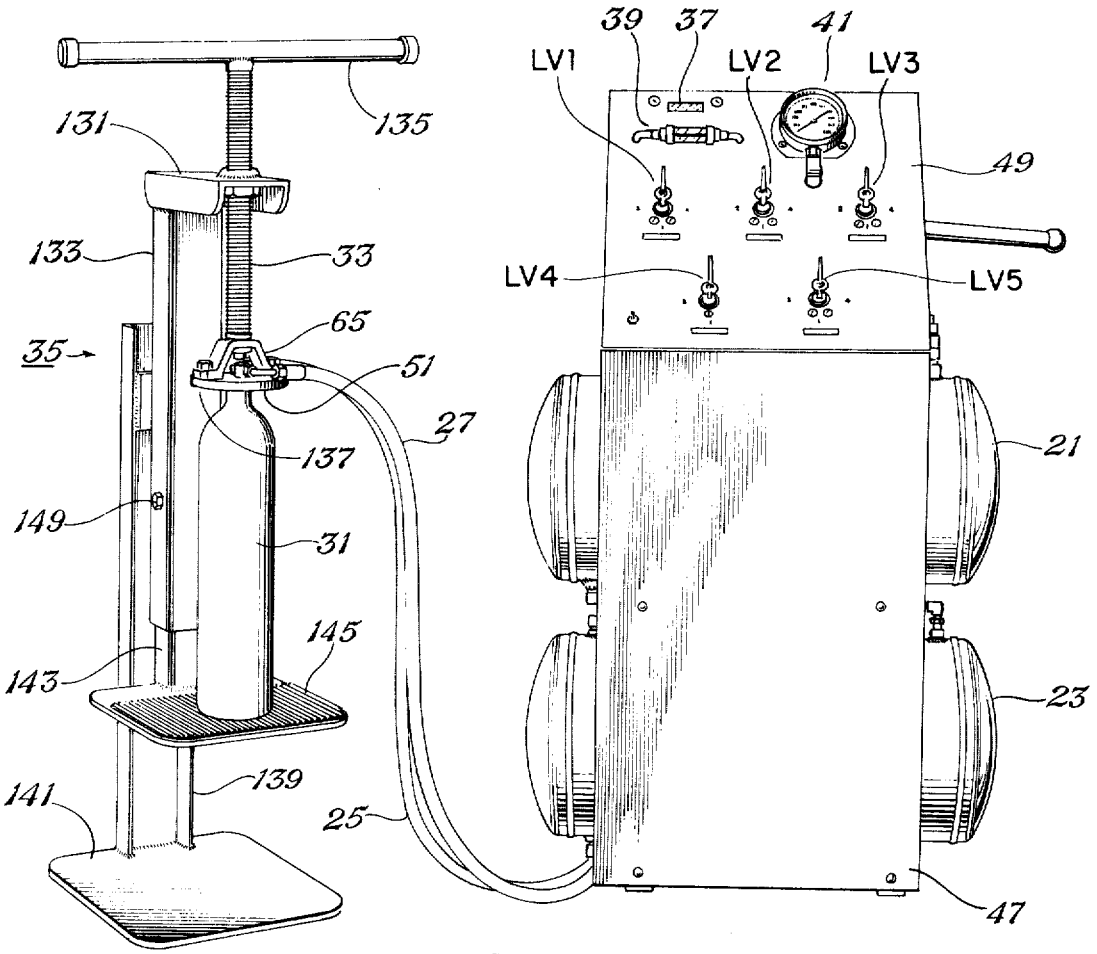
FIG. 1 illustrates the two tanks of the closed system of the present invention, supported by a stand, and the holding device with its universal head for holding a fire extinguisher container for test purposes and then for inverting the container to empty the container of liquid.
Figure 3:
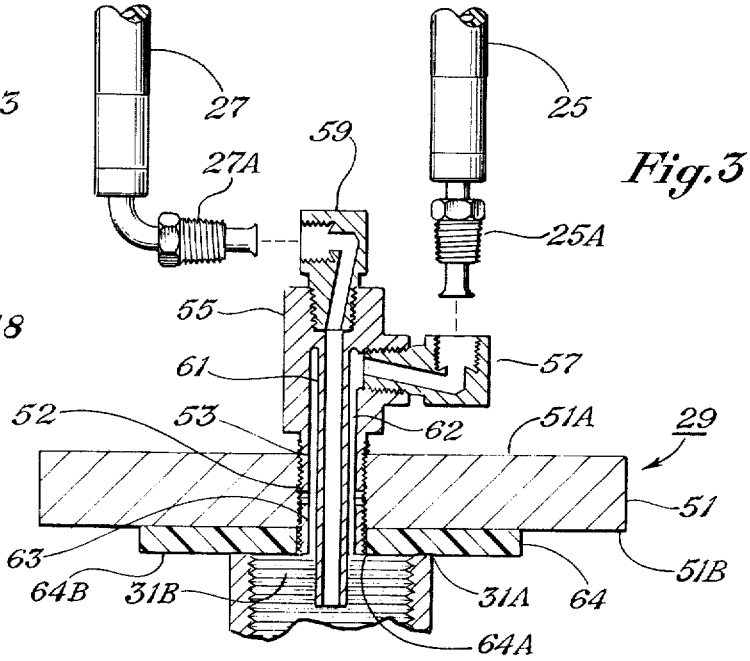
FIG. 3 is an enlarged cross-sectional view of the universal head employed with the holding device of the closed system of the present invention.

Referring now to the drawings, the closed system comprises two tanks 1 and 2, a valve control system comprising valves V1–V5 and flow lines including first and second flexible conduits 25 and 27, coupled to the valve control system and having ends coupled to a universal head 29. One of the tanks is filled with a liquid chemical which has good cleaning and drying characteristics, vaporizes rapidly, and is nonflammable. Preferably, the liquid chemical employed is trichloroethane which has the above characteristics. The trichloroethane employed also includes a rust inhibitor. Since this liquid chemical is toxic and has a high vapor pressure, it must be employed in a closed system. As illustrated in FIGS. 1 and 3, the head 29 is adapted to fit over the rim 31A forming the opening 31B of a conventional, metal fire extinguisher bottle or container 31 after its dispensing mechanism (not shown) has been unthreaded from the neck and removed from the container. The head 29 is connected to a threaded rod 33 of a holding device 35 which is employed for holding or clamping the head 29 over the opening 31B in a sealing relationship while liquid from one of the tanks is flowed into the container 31 and pressurized for a short period of time to clean, pressure test, and dry the container. After the pressure test, the container 31, while held by the device 35, is inverted to allow the liquid to be flowed from the container to the other of the tanks. Since the liquid chemical evaporates rapidly, the container thus dries rapidly. Hence, the container is pressure tested, cleaned, and dried in a minimum of time.

The closed system also comprises a sight glass 37, a filter 39, a pressure gause 41, a high pressure pump 43, and a source 45 of low pressure gas which may comprise air or nitrogen or other compressed gases. The tanks 1 and 2 are supported on a stand 47 which also supports other components of the closed system. Supported on a test panel 49 of the stand 47 are hand actuated levers LV1–LV5 for controlling the valves V1–V5 respectively. Also mounted on the panel are the sight glass 37, filter 39, and pressure gauge 41.

The universal head 29; the flow control valves; the flow connections between the various control valves of the closed system; and the holding device 35 will be described now in detail. Referring first to FIG. 3, the head 29 comprises a flat metal disc-like plate 51 having a threaded aperture 52 extending therethrough. Threaded into the aperture 52 from the top side 51A of the plate 51 is a tubular member 53 which extends from a fitting 55. The fitting 55 has at its upper end two connectors 57 and 59. A central tube 61 extends through the tubing 53 to the connector 59 defining an annulus 62. Connector 59 is in fluid communication with tube 61 while connector 57 is in fluid communication with the annulus 62 formed between tubing 53 and the central tube 61. The end of flexible conduit 25 has a fitting 25A connected thereto which is threaded to the connector 57 such that conduit 25 is in fluid communication with the annulus 62. Similarly, the end of flexible conduit 27 has a fitting 27A connected thereto which is threaded to connector 59 such that conduit 27 is in fluid communication with the central tube 61. Threaded into aperture 52 from the bottom side 51B of plate 51 is a tubular member 63 which surrounds tube 61 and defines an extension of the annulus 62. It is noted the the lower ends of tubes 61 and 63 both extend beyond the bottom side 51B of plate 51 with the end of tube 61 extending further than the end of tube 63. A disc-like flexible seal gasket 64, having a central aperture 64A, is pressed around the tube 63 against the bottom side 51B of the plate 51 whereby its lower side 64B may engage and form a seal with the rim 31A of the container to be tested. When the lower side 64B of the seal gasket engages the rim 31A of the container as illustrated in FIG. 3A, the tubes 61 and 63 will be located centrally of the opening 31B such that conduits 25 and 27 both will be in fluid communication with the interior of the container 31. The gasket 64 has a thickness such that the end of tube 63 is flush with the bottom side 64B of the gasket while the lower end of tube 61 extends downward beyond the gasket 64. The top of the plate 51 has a C-shaped member 65 connected thereto which also is connected to the lower end of the threaded rod 33 as will be described subsequently.

The gasket 64 must be formed of a material which has a toughness and resiliency sufficient to form a seal and to withstand repeated use without being cut by the rims of the containers which sometimes are sharp since the containers are formed of metal. It also must be able to withstand pressures up to 1,000 psi and must be non-porous. In addition, the material must be unaffected by trichloroethane. One such material which has these characteristics and has been found to be satisfactory is styrene-butadiene synthetic rubber reinforced with silica. It has an abrasion of 90 on the durometer scale. It is commercially available under the trade names of CATEX or for example, NEOLITE.

Figure 2:
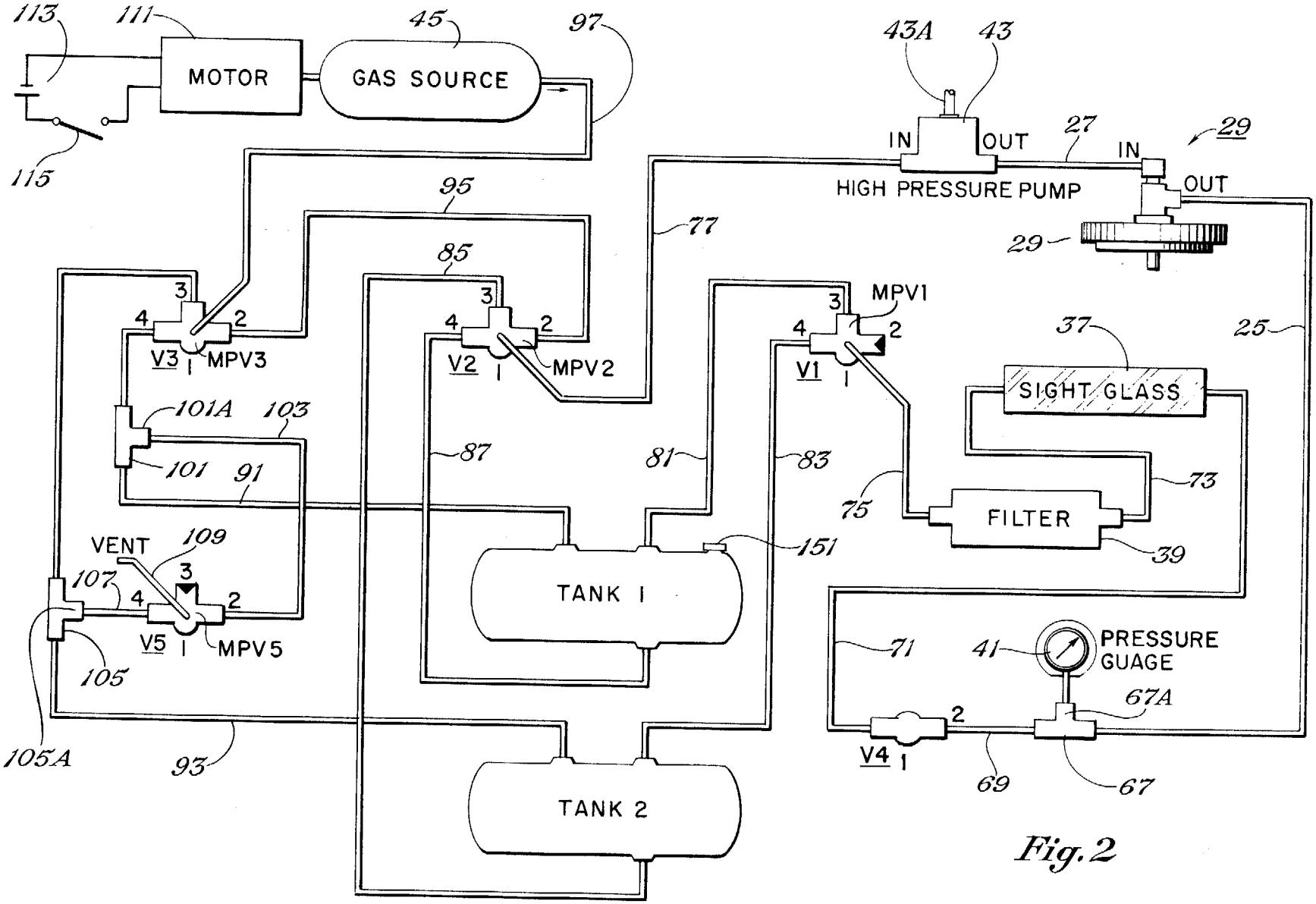
FIG. 2 is a schematic illustration of the closed system.

The valves V1–V3 and V5 are four-way hand operated valves which are commercially available while valve V4 is a two-way on/off hand operated valve which is also commercially available. Referring to FIG. 2, each of the valves V1–V3 and V5 has a main port MPV1–MPV3 and MPV5 respectively and three selectable ports labeled 2–4. Either of the three selectable ports 2–4 of valves V1–V3 and V5 may be connected in fluid communication with its main port by proper positioning of its hand actuated lever to either of three positions corresponding to ports 2–4. When the hand actuated lever of valve V1–V3 and V5 is located in a position corresponding with the position labeled 1, the valve is closed and flow through the valve is terminated. For example, referring to valve V3, any of its ports 2–4 may be connected to its main port MPV3 by moving its lever LV3 to positions corresponding with ports 2–4 respectively. Movement of the lever to the 1 position terminates flow through the valve. As employed in the system of FIG. 2, port 2 of valve V1 is plugged and port 3 of valve V5 is plugged. Valve V4 also has a hand operated lever LV4 which may be moved to a position corresponding to the 1 position to close the valve or to a position corresponding to the 2 position to allow flow through the valve.

Referring to FIG. 2, conduit 25 is coupled to the main port of the valve V1 by way of pressure gauge 41, valve V4, sight glass 37, and filter 39. In this respect, a T-connection 67 is connected to the flexible conduit 25 and pressure gauge 41 is connected to the end 67A of the T 67. A conduit 69 is connected to the other end of the T connection and also to the port labeled 2 of the valve V4. A conduit 71 is connected to the other port of the valve V4 and to the sight glass 37. Conduit 73 is connected to the other end of the sight glass and to the filter 39 while conduit 75 is connected to the other end of the filter 39 and to the main port of the valve V1.

Flexible conduit 27 is connected to the port labeled out of the hand pump 43 while conduit 77 is connected to the in port of the hand pump and to the main port of valve V2. A first pair of conduits 81 and 83 are coupled to the tops of tanks 1 and 2 and to ports 3 and 4 respectively of valve V1. A second pair of conduits 87 and 85 are connected to the bottom ends of tanks 1 and 2 and to ports 4 and 3 respectively of valve V2. A third pair of conduits 91 and 93 are also connected to the top of tanks 1 and 2 and ports 4 and 3 respectively of valve V3. Port 2 of valve V2 is connected to port 2 of valve V3 by way of conduit 95. The main port of valve V3 is connected to the source 45 by way of conduit 97. Conduit 91 has a T-connection 101 coupled thereto with its end 101A connected to port 2 of valve V5 by way of conduit 103. Conduit 93 has a T-connection 105 coupled thereto with its end 105A connected to port 4 of valve V5 by way of conduit 107. The main port of valve V5 has a vent conduit 109 connected thereto.

In one embodiment, gas source 45 comprises an air pump driven by a DC motor 111 which may be supplied with power from a battery 113 of the service vehicle. An on/off switch 115 is employed to control operation of the motor 111 and hence the air pump which is a small pump capable of producing 40 pounds of air pressure. Although not shown, the pump employs a regulator to insure that the pressure does not exceed 40 psi. When 40 psi is reached, the air pump on the truck unit will automatically shut off. In another embodiment, source 45 may be a cylinder filled with nitrogen under pressure. An on/off valve will be employed, as well as a regulator set at 75 psi. The pump 43 is a high pressure, hand operated pump capable of producing pressures up to 1,000 psi. The handle 43A is employed for operating this pump.

Figure 4:
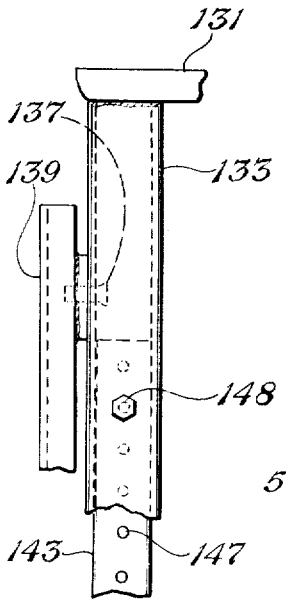
FIG. 4 is a partial side view of the holding device of FIG. 1.

Referring now to the holding device of FIGS. 1 and 4, the threaded rod 33 of the device 35 is threaded through a transverse beam 131 which is attached to the top end of a square tubular member 133. Member 133 is pivotally connected by way of pivotal connection 137 to a vertical stand 139 supported by a base 141. Supported for sliding movement within the tube 133 is another square tube 143 which has a base 145 connected to its lower end for receiving the lower end of the container 31. The tube 143 has a plurality of pairs of apertures 147 formed through opposite sides while tube 133 has a single pair of apertures 148 formed through opposite sides for alignment with one of the pairs of apertures 147 to receive a bolt 149 to couple the two tubes 133 and 143 together at a desired position. The upper end of the rod 33 has a handle 135 connected thereto for threading the rod 33 upward or downward relative to the base 145 when the tubular members 133 and 143 are located in the positions in FIG. 1. Since the plate 51 is coupled to the lower end of the threaded rod 33 by way of member 65, the plate 51 will be moved toward or away from the base 145 when the rod 33 is threaded downward or upward as seen in FIG. 1. The coupling between the rod 33 and the member 65 is such that the threaded rod 33 may turn within the member 65 which is prevented from turning due to the connection of conduits 25 and 27 with the plate 51. The purpose of the plurality of pairs of apertures 147 is to allow the distance between the tranverse beam 131 and the base 145 to be adjusted to allow the device 35 to receive containers of different lengths.

The closed system will be prepared for carrying out the tests by filling tank 1 with liquid trichloroethane, including a rust inhibitor. The tanks 1 and 2 are 12-gallon tanks, however, only 10 gallons of trichloroethane will be used to allow air space for transferring the liquid rapidly. The liquid is inserted into tank 1 through a port 151 having a removable plug. After filling operations, the plug will be replaced. Having filled tank 1 with 10 gallons of trichloroethane and assuming source 45 is an air pump, the pump is turned on by closing switch 115. The hand lever LV3 of valve V3 then is turned to position 4. This allows the pressure in tank 1 to build up to 40 psi to prepare the system for use without delay. After air pump automatically shuts off, all hand levers LV1–LV5 are turned to position 1.

In carrying out a test for a given fire extinguisher, the dispensing head of the extinguisher will be actuated to remove all of its dry powder, after which its dispensing head will be unthreaded from the neck of the container and removed. The container then may be inverted and tapped to remove any additional loose material through its opening 31B. The container next is placed on the base 145 of holding device 35 and the head plate 51 moved downward by turning handle 135 of rod 33 to allow the gasket 64 to tightly engage the top rim 31A of the container 31 to be tested to form a seal. Depending upon the size of the container, adjustment of telescoping members 133 and 143 may be required to adjust the distance between the base 145 and the beam 131.

After the bottle or container is placed on the holding device, and the head 29 adjusted downward to form a seal with the rim of the container, the following steps are taken in the following sequence. First, the hand levers LV1–LV5 of the valves V1–V5 are turned to the following positions in the following sequence. Valve V2 to position 4; valve V1 to position 4; valve V3 to position 4; valve V4 to position 2; and valve V5 to position 4. This allows liquid to flow from the bottom of tank 1 to the container being tested. Flow is by way of conduit 87, valve V2, conduits 77, pressure pump 43, flexible conduit 27, and central tube 61 of head 29. Air from the container will flow out to tank 2 and then through vent 109. Flow is by way of annulus 62 of the head 29, through flexible conduit 25, conduit 69, valve V4, conduit 71, sight glass 37, conduit 73, filter 39, conduit 75, valve V1, conduit 83 and into tank 2. Tank 2 is vented by way of conduit 93, conduit 107, valve V5, and vent 109. During the filling process, air from the pump 45 is also applied to tank 1 by way of conduit 97, valve V3, and conduit 91.

When the container becomes filled, liquid can be seen passing through the sight glass 37. Air bubbles also will be intermixed with the liquid which is caused from the air escaping from the container. Since the lower end of tube 63 of head 29 will be higher than the lower end of the central tube 61 (in the upright position of the container) and is flush with the lower side of the seal gasket 64, all of the air will be insured of removal from the container. This is important to prevent the container from exploding during the pressure test and to insure an accurate test. When there are no air bubbles observed passing through the sight glass 37, lever LV4 of valve V4 is turned to position 1 to terminate flow of liquid from the container being tested. The pump handle 43A of the high pressure pump 43 then is operated to apply a desired amount of pressure to the container determined by its recommended pressure level. Generally the pressure test recommended will range between 300–700 psi. The pressure may be read from gauge 41. After the desired pressure level is obtained, the pressure is maintained for a period of about 60 seconds. During the 60-second test period, the hand levers of other valves are turned to position 1. During the time that the pressure is maintained within the container, the container and gauge 41 are observed to determine if there are leaks in the container. At the same time the pressure test is being carried out, the liquid chemical acts to dissolve all foreign matter within the container thereby cleaning the container. After the test has been carried out for the desired period of time and it is seen that the test is satisfactory, the liquid is removed from the container. This is accomplished by rotating the telescoping members 133 and 143, 180° on pivot pin 137 to invert the container while held by the holding device 35 and moving the hand levers LV1–LV5 of valves V1–V5 to the following positions in the following sequence. Valve V1 to position 4; valve V2 to position 2; valve V3 to position 2; valve V4 to position 2; and valve V5 to position 4. In these valve positions, the liquid from the bottle will be emptied into tank 2. Flow is by way of annulus 62 of head 29, conduit 25, conduit 69, valve V4, conduit 71, sight glass 37, conduit 73, filter 39, conduit 75, valve V1 and conduit 83. The top of tank 2 is vented by way of conduit 93, conduit 107, valve V5 and vent 109. In addition, air is being injected into the fire extinguisher container from the air pump 45 by way of conduit 97, valve V3, conduit 95, valve V2, conduit 77, hand pump 43, conduit 27, and central tube 61 of the head 29. This air flows upward to the inverted bottom of the container and then pushes the liquid out through annulus 62, conduit 25, etc. When the fire extinguisher container is empty, there will be no liquid flow seen through the sight glass 37. When liquid flow stops, the flow of air into and out of the container is continued for about 15 to 30 seconds dependent upon the size and shape of the container. This will allow air to flow through the container at 40 psi thus drying any liquid residue remaining in the container.

Having removed all of the liquid from the container and having dried the container while it is inverted, the hand levers LV1–LV5 of the valves V1–V5 then are moved to the following positions in the following sequence. Valve V4 to position 1, valve V1 to position 1, valve V2 to position 1, valve V3 to position 1 and valve V5 to position 1. In these positions, all of the valves will be closed. The fire extinguisher container in the holding device then is turned to an upright position and the container removed from its holder, inspected and returned to service. The hand levers of all of the valves are left in the 1 positions except that hand lever LV3 of valve V3 is turned to position 4 to maintain the pressure on the tank in use so that the system will be ready for the next test.

After tank 1 is exhausted, tank 2 can be used by reverse flowing the liquid through the containers to be tested. A determination as to when tank 1 becomes empty can be made by viewing the sight glass 37 during the filling portion of a test. When there is no liquid flow through the sight glass during the filling portion, it can be determined that there is no further liquid flowing from tank 1 to the container. Since the operator is in the middle of a test he probably will not want to start the test over. The following steps can be followed to continue filling the container from tank 2. These steps are the same steps that would be used if the operator were starting a new test using tank 2 for filling instead of tank 1. When using tank 2 for filling, initially all of the hand levers of the valves will be turned to the 1 position except that hand lever LV3 of valve V3 will be turned to the 3 position to allow pressure to build up in tank 2. The hand levers of the valves then are moved to the following positions in the following sequence. Valve V2 to position 3; valve V1 to position 3; valve V3 to position 3; valve V4 to position 2; and valve V5 to position 2. This vents tank 1, pressurizes tank 2 and allows the container to be tested to be filled from tank 2. Flow from tank 2 is by way of conduit 85, valve V2, conduit 77, hand pump 43, conduit 27, and central tube 61 of head 29. The sight glass is observed for liquid flow and after air bubbles are not viewable in the liquid flowing through the sight glass, it can be determined that the container is full of liquid. Hand lever LV4 of valve V4 then is turned to the 1 position. The pump handle 43A next is actuated to obtain the desired pressure in the container and this pressure is maintained for the 60-second test, as described above. During the 60-second test period, the hand levers of all of the other valves are turned to the 1 position. After this period of time, the extinguisher container is inverted and the hand levers of the valves moved to the following positions in the following sequence. Valve V1 to position 3, valve V2 to position 2, valve V3 to position 2, valve V4 to position 2, and valve V5 to position 2. This allows air to be injected into the container through conduit 27 and the liquid to be forced out of the container into tank 1. When the container is empty, there will be no more liquid viewable in the sight glass. Air flow through the container then is continued for about 15 to 30 seconds dependent upon the size and shape of the container to dry any liquid residue remaining in the container. The hand levers of the valves next are moved to the following positions in the following sequence. Valve V4 to position 1; valve V1 to position 1, valve V2 to position 1, valve V3 to position 1, and valve V5 to position 1. The fire extinguisher container then is turned upright and removed from its holder, inspected and returned to service. As now can be understood by use of trichloroethane as the cleaning and testing agent, cleaning and pressure testing can be performed all at the same time and drying can be done substantially instantly since trichloroethane has a high vapor pressure. By using a closed system, trichloroethane may be used even though it is toxic. By using a rust inhibitor, the effectiveness and lifetime of the closed system is increased. In addition, by use of the closed system, including the sight glass 37, there is no waste of the test liquid and no escape of fumes. Since trichloroethane is very expensive, waste is undesirable. Since the test can be carried out rapidly (any size conventional bottle or container may be tested in 5 to 7 minutes), time is saved, as well as money. Moreover, the test may be carried out on a service vehicle, thereby eliminating the trip back to the shop as mentioned previously. If desired, the same equipment can be used in the shop.

Since the flow of liquid from one tank to the other may be reversed by proper operation of the valve system, there is no delay in continuing the test when one tank becomes empty.

By use of the test head of the present invention, no special test adaptors are required whereby all sizes of bottles or containers may be tested on a service vehicle without the requirement of a large number of test adaptors which otherwise would be required. Moreover, by use of the test head of the present invention, rather than an adaptor threaded into the neck, not only the bottle or container is tested, but also its neck. By use of the sight glass, there is insured removal of all air from the bottle or container without loss of liquid during the filling process and in addition, during the emptying process there is insured removal of all liquid from the bottle. The filter is employed to collect all foreign matter left in the bottle and may be cleaned and reused. From experience, it has been found that many tests may be carried out before the trichloroethane in the closed system is required to be changed and fresh trichloroethane employed.

In one embodiment, the O-ring seals employed in the high pressure pump are formed of a material identified as VITON which is unaffected by trichloroethane. The plate 51 has an outside diameter of 4⅞ inches and a thickness of three-quarter inches and is formed of metal. Tube 63 extends one-quarter of an inch below the bottom 51B of plate 51 while tube 61 extends one-half of an inch below the bottom 51B of plate 51. Four sizes of gasket seals may be employed. These gasket seals each have a height of one-quarter of an inch and outside diameters of 1½ inches, 2½ inches, 3½ inches and 4½ inches. These four sizes are sufficient to test all sizes of fire extinguisher containers or bottles now on the market. One gasket may be readily removed by slipping it off of the tube 63 and press fitting another gasket around the tube 63 next to the plate 51.

By forming the bottle holder 35 from the two telescoping members 133 and 143 which may be adjusted to accept containers of different lengths, the overall length of the threaded rod 33 may be reduced thereby allowing the tests to be carried out in a conventional econoline van having a floor to top height of 54 inches. In one embodiment, the rod 33 has a diameter of 1¼ inches and has eight threads to the inch. Its length is 12 inches. The telescoping member 133 has a length of 24 inches while telescoping member 143 has a length of 23½ inches. The height of the stand 139 is 39 inches. Valves V1–V5 are manufactured by Imperial Eastman and may be purchased from Kins International, Fort Worth, Tex. Trichloroethane having a rust inhibitor may be purchased from Van Waters & Rogers of Dallas, Tex. It is identified as TRICHLOROETHANE-III-NEW.

We claim:

1. A closed system for cleaning and pressure testing and drying a container adapted to contain a fluid under pressure and having an opening leading to its interior comprising:

two tanks for holding a volume of liquid less than a total volume of said two tanks and which liquid has good cleaning characteristics, vaporizes rapidly, and is nonflammable, a liquid disposed in at least one of said two tanks; said liquid being nonflammable, having good cleaning characteristics for cleaning said container automatically when flowed thereinto for said pressure test, and vaporizing rapidly so as to dry said container rapidly and automatically when exposed to a gaseous fluid and ambient conditions following a pressure test, first and second conduits having first ends adapted to be coupled in fluid communication with the interior of said container to be cleaned, pressure tested and dried, by way of its opening, a first pair of flow lines comprising two lines separately coupled to the top ends of said two tanks, first flow control means for separately coupling said first conduit with either of said lines of said first pair, a second pair of flow lines comprising two lines separately coupled to the bottom ends of said two tanks, second flow control means for separately coupling said second conduit with either of said lines of said second pair of flow lines, means for effecting the flow of said liquid from one of either of said two tanks, by way of said second flow control means, to said container and from said container, by way of said first flow control means, to the other of said two tanks, said means for effecting the flow of said liquid being connected with at least one of said tanks, means for pressurizing said container when filled with said liquid, and pressure gauge means for indicating when a predetermined pressure has been achieved within said container, and said means for pressurizing and said pressure gauge means being fluidly connnected with the interior of said container when said first and second conduits are coupled in fluid communication therewith during the pressure test thereof.

2. The closed system of claim 1 comprising:

plate means having a layer of sealing material on one side adapted to engage the rim forming the opening of said container to be cleaned, pressure tested, and dried, two fluid passages extending through said plate means and through said layer of sealing material to be located in fluid communication with the interior of said container when said plate means and its layer of sealing material are positioned to engage said layer of sealing material with the rim of said container to be cleaned, pressure tested, and dried, said first ends of said first and second conduits being connected to said first and second passages respectively on the side of said plate means opposite said layer of sealing material.

3. The closed system of claim 2 wherein:

said layer of sealing material is characterized as being resilient, non-porous, capable of withstanding pressures up to 1,000 psi and unaffected by trichloroethane.

4. The closed system of claim 3 wherein:

said layer of sealing material is formed of styrene-butadiene synthetic rubber reinforced with silica.

5. The system of claim 1 comprising:

a sight glass connected to said first conduit between its first end and said first flow control means.

6. The system of claim 1 wherein:

said means for effecting the flow of liquid comprises fluid pressure means for applying fluid pressure to either of said two tanks.

7. The system of claim 1 wherein said means for pressurizing said container comprises a pressure pump.

8. The system of claim 1 wherein:

said means for effecting the flow of liquid comprises:

a source of gas pressure, a gas pressure line, and means for coupling said source of gas pressure to either of said two tanks or to said gas pressure line, said second flow control means being adapted to couple said gas pressure line to said second conduit, said means for pressurizing said container comprises:

a gas pressure pump coupled to said second conduit.

9. A closed system for cleaning and pressure testing and drying a container adapted to contain a fluid under pressure and having an opening leading to its interior comprising:

two tanks for holding a volume of liquid less than the total volume of said two tanks and which liquid has good cleaning characteristics, vaporizes rapidly, and is nonflammable, first and second conduits having first ends adapted to be coupled in fluid communication with the interior of said container to be cleaned, pressure tested, and dried, by way of its opening, a first pair of flow lines comprising two lines separately connected to the top ends of said two tanks, first flow control means for separately connecting said first conduit with either of said lines of said first pair, a second pair of flow lines comprising two lines separately connected to the bottom ends of said two tanks, second flow control means for separately connecting said second conduit with either of said lines of said second pair of flow lines, a sight glass connected to said first conduit between its first end and said first flow control means, a pressure pump coupled to said second conduit for pressurizing said container during the pressure test thereof, a pressure gauge means in fluid communication with the discharge of said pressure pump and said container at least during said pressure test for indicating when a predetermined pressure has been achieved, a gas pressure line, said second flow control means being adapted to separately connect said second conduit with either of said lines of said second pair or with said gas pressure line, a third pair of flow lines comprising two lines separately connected to the top ends of said two tanks respectively at positions different from the connection of said lines of said first pair with the top ends of said two tanks, a source of gas under relatively low pressure, a third flow control means for separately connecting said source with either of said lines of said third pair or with said gas pressure line, a fourth flow control means coupled to said first conduit between its first end and said sight glass for controlling flow through said first conduit, a vent, and a fifth flow control means for separately connecting either of said lines of said third pair to said vent.

10. The system of claim 9 comprising:

plate means having a layer of sealing material on one side adapted to engage the rim forming the opening of said containter to be cleaned, pressure tested, and dried, two fluid passages extending through said plate means and through said layer of sealing material to be located in fluid communication with the interior of said container when said plate means and its layer of sealing material are positioned to engage said layer of sealing material with the rim of said container to be cleaned, pressure tested, and dried, said first ends of said first and second conduits being connected to said first and second passages respectively on the side of said plate means opposite said layer of sealing material.

11. The system of claim 10 wherein:

said layer of sealing material is characterized as being resilient, non-porous, capable of withstanding pressures up to 1,000 psi, and unaffected by trichloroethane.

12. The system of claim 11 wherein:

said layer of sealing material is formed of styrene-butadiene synthetic rubber reinforced with silica.

13. The system of claim 10 comprising a holding device for holding said plate means and its layer of sealing material over the opening of said container to be cleaned, pressure tested, and dried and for inverting said container, said holding device comprising:

a first elongated member, support means extending transversely from one end of said first elongated member for supporting the bottom of said container, a second elongated member, a transverse member extending transversely from one end of said second elongated member, means for coupling said two elongated members together to locate said support means and said transverse member at spaced apart positions to receive said container therebetween with its bottom supported on said support means, a rod threaded through said transverse member, means for connecting the top side of said plate means to the end of said rod between said transverse member and said support means to allow the layer of sealing material of said plate means to fit over the rim and close the opening of said container when it is supported on said support means, said rod being adapted to be threaded away from said support means to receive said container between said support means and said layer of sealing material of said plate means and adapted to be threaded toward said support means to grip and hold said container with its bottom engaging said support means and said layer of sealing material engaging the rim and closing the opening of said container, a support base having support structure extending therefrom and adapted to be supported in a vertical position, and pivot means connected to said support structure and to one of said elongated members to support said elongated members above said support base sufficient to allow said elongated members to be turned from a position wherein said support means is below said threaded rod and plate means, to a position wherein said support means is above said threaded rod and plate means to allow said container to be supported and held in an upright position and inverted while gripped between said plate means and said support means with its bottom engaging said support means and said layer of sealing material engaging its rim and closing its opening.

14. The holding device of claim 13 comprising:

means for coupling said two elongated members together at different positions to allow the space between said support means and said transverse member to be varied to receive containers of different lengths.

15. A method of cleaning and pressure testing and drying a container adapted to contain a fluid under pressure, said method employing a closed system, said system comprising:

two tanks for holding a volume of liquid less than the total volume of said two tanks and which liquid has good cleaning characteristics, vaporizes rapidly, and is nonflammable, a liquid disposed in at least one of said two tanks; said liquid being nonflammable, having good cleaning characteristics for cleaning said container automatically when flowed thereinto for said pressure test, vaporizing rapidly so as to dry said container rapidly and automatically when exposed to a gaseous fluid and ambient conditions following a pressure test, first and second conduits adapted to be coupled to an opening of said container to be cleaned, pressure tested, and dried, said first conduit having a sight glass coupled thereto, a valve control system coupled between said two tanks and said two conduits, means for effecting the flow of said liquid from one of either of said two tanks to said container and from said container to the other of said two tanks, means for pressurizing said container, and pressure guage means for indicating when a predetermined pressure within said container has been attained, said method comprising the steps of:

flowing liquid from one of said tanks through said second conduit to said container to fill said container with liquid from said one tank, while said container is being filled with liquid, venting said container by way of said first conduit to the other of said tanks, when liquid begins to flow through said first conduit from said container with little or no air intermixed therewith as seen through said sight glass, terminating liquid flow through said first conduit, applying pressure to said liquid in said container to clean and pressurize said container to a predetermined pressure for a pressure test and inverting said container and flowing said liquid from said container to the other of said tanks by way of said first conduit to empty said container of the liquid and to transfer the liquid to the other of said tanks; and to automatically effect drying of said container by the automatic vaporizing of said liquid therefrom when said container is returned to ambient conditions.

16. The method of claim 15 wherein said liquid employed comprises trichloroethane including a rust inhibitor.

17. Apparatus for holding and inverting a container to be cleaned, pressure tested, and dried and which container has a rim forming an opening located opposite its bottom end, said apparatus comprising:

a first elongated member, a support means extending transversely from one end of said first elongated member for supporting the bottom of said container, a second elongated member, a transverse member extending transversely from one end of said second elongated member, means for coupling said two elongated members together to locate said support means and said transverse member at spaced apart positions to receive said container therebetween with its bottom supported on said support means, a rod threaded through said transverse member and having an end located between said transverse member and said support means, closure means coupled to said end of said rod and adapted to engage the rim and close the opening of said containter when it is supported on said support means, said closure means having two passages extending therethrough, one of said passages terminating at a first position at the uppermost end of the space enclosed by said container and said closure means when said closure means is affixed thereto for pressure testing of said container, the other of said two passages terminating at a second position slightly farther downward from said first location and into said space when said container is in an upright position for flowing liquid downwardly into said container and effecting removal of all of the gaseous fluid out of said container for the pressure test, said other of said ends of said two passages extending upwardly into said container above said first position when said container is inverted for flowing a gaseous fluid into said container for effecting removal of a liquid therefrom, said rod being adapted to be threaded away from said support means to receive said container between said support means and said closure means and adapted to be threaded toward said support means to grip and hold said container with its bottom engaging said support means and said closure means engaging the rim and closing the opening of said container, a support base having elongated support structure extending therefrom and adpated to be supported in a vertical position, and pivot means connected to said support structure and to one of said elongated members to support said elongated member above said support base sufficient to allow said elongated members to be turned from a position wherein said support means is below said threaded rod and closure means to a position wherein said support means is above said threaded rod and closure means to allow said container to be supported and held in an upright position and inverted while gripped between said closure means and said support means with its bottom engaging said support means and said closure means engaging its rim and closing its opening.

18. The apparatus of claim 17 comprising:

means for coupling said two elongated members together at different positions to allow the space between said support means and said transverse member to be varied to receive containers of different lengths.

19. The apparatus of claim 18 wherein said closure means comprises:

plate means having a layer of sealing material on one side adapted to engage the rim forming the opening of said container to be cleaned, pressure tested, and dried, and two fluid passages extending through said plate means and through said layer of sealing material to be located in fluid communication with the interior of said container when said plate means and its layer of sealing material are positioned to engage said layer of sealing material with the rim of said container to be cleaned, pressure tested, and dried.

20. The apparatus of claim 19 wherein:

said layer of sealing material is characterized as being resilient, non-porous, capable of withstanding pressures up to 1,000 psi, and unaffected by trichloroethane.

21. The apparatus of claim 20 wherein:

said layer of sealing material is formed of styrene-butadiene synthetic rubber reinforced with silica.

22. The apparatus of claim 19 wherein:

one of said passages extends through said plate means and through said layer of sealing material to a position flush with the outward facing side of said layer of sealing material, the other of said passages extends through said plate means and through said layer of sealing material to a position beyond said outward facing side of said layer of sealing material.

23. The apparatus of claim 17 wherein said closure means comprises:

plate means having a top side and a bottom side, two conduits extending through said plate means from said top side to said bottom side and having their ends extending to two different positions beyond said bottom side, a layer of sealing material adapted to surround said ends of said conduits with one side engaging said bottom side of said plate means and an opposite side adapted to engage the rim forming the opening of said container to be cleaned, pressure tested, and dried, said ends of said two conduits adapted to be located in fluid communication with the interior of said container when said plate means and said layer of sealing material are positioned to engage said opposite side of said layer of sealing material with the rim of said container to be cleaned, pressure tested, and dried.

24. The closure means of claim 23 wherein said layer of sealing material is characterized as being resilient, non-porous, capable of withstanding pressures up to 1,000 psi, and unaffected by trichloroethane.

25. The closure means of claim 24 wherein:

said layer of sealing material is formed of styrene-butadiene synthetic rubber reinforced with silica.

26. The closure means of claim 24 wherein:

the end of one of said conduits extends to a position flush with said opposite side of said layer of sealing material when said one side engages said bottom side of said plate means, and the end of the other of said conduits extends to a position beyond said opposite side of said layer of sealing material when said one side engages said bottom side of said plate means.

* * * * *